United States Patent [19]

Slater et al.

[11] 4,086,549

[45] Apr. 25, 1978

[54] CIRCUIT INTERRUPTER RELAY

[75] Inventors: Thomas S. Slater, Port Washington; Harald B. Jadatz, Deer Park, both of N.Y.

[73] Assignee: Slater Electric Inc., Glen Cove, N.Y.

[21] Appl. No.: 680,922

[22] Filed: Apr. 28, 1976

[51] Int. Cl.[2] ..... H01H 83/02

[52] U.S. Cl. ..... 335/18; 335/21; 335/173

[58] Field of Search ..... 335/18, 21, 24, 22, 335/167, 168, 169, 170, 171, 172, 173, 174, 175; 317/18 D

[56] References Cited

U.S. PATENT DOCUMENTS

| | | | |
|---|---|---|---|
| 4,001,652 | 1/1977 | Klein et al. | 335/18 |
| 4,034,266 | 1/1977 | Virani et al. | 361/42 |

*Primary Examiner*—Harold Broome

*Attorney, Agent, or Firm*—Morgan, Finnegan, Pine, Foley & Lee

[57] ABSTRACT

At least one stationary electrical contact is fixedly mounted in a housing and an equal number of corresponding movable contacts is affixed to a movable member pivotally mounted within the housing and positioned thereon to mate with the stationary contact, however, first biasing means are coupled between the movable member and the housing to retard mating of the contacts. An actuating member is slidably pivotally mounted within the housing and adapted to engage the movable member, with biasing means coupled between the actuating member and the housing to overcome the first biasing means and urge the movable and stationary contacts into mating relation when the actuating and movable members have been engaged. Release means, controlled by circuit fault sensing means, are positioned adjacent the actuating member for causing the actuating arm to be released from the movable member when predetermined circuit conditions are detected by the sensing means, to disjoin the stationary and movable contacts.

25 Claims, 9 Drawing Figures

CIRCUIT INTERRUPTER RELAY

BACKGROUND AND OBJECTS OF INVENTION

The present invention relates generally to electrical circuit protecting devices, and more particularly, as preferably embodied, to electromagnetic circuit interrupters for ground fault protection.

The art is replete with circuit breakers used in various applications such as, for example, in protecting a circuit (hereinafter, the "primary circuit") against overload or against ground fault leakage currents. Circuit interrupters utilized in devices of the former type generally include thermal breakers which are designed to fail when the predetermined overload current is detected. Although these devices have provided generally satisfactory results, their tripping mechanisms have sometimes proved unreliable or have been subject to nuisance tripping.

Regarding ground fault protection devices, increasing concern over ground fault leakage, especially where electrical conductors and outlets may cause personal injury, has led to nationwide requirements for new housing units. These requirements call for the installation of ground fault protection devices in electrical outlets located where there may be contact with water, such as in exterior outlets on homes, in swimming pool areas, in bathrooms and in basements. Moreover, it is anticipated that ground fault protection devices may soon be required for every electrical outlet in homes and apartments.

Circuit protection devices should, therefore, be highly dependable and provide the primary (or protected) circuit with automatic protection along with fail-safe features. In addition, these devices should provide protection even while the device is being reset in case the fault has not been corrected. Moreover, the reset mechanism should not enable an operator to manually close the circuit and keep it closed for overriding the automatic interrupter system.

Among known circuit interruption mechanisms, such as disclosed in U.S. Pat. No. 3,214,537 issued to Krieger, tripping is implemented through a combination of tripping armatures and latching members for releasing contact-carrying members. Although these devices may provide adequate results, there may be operational and assembly problems encountered due to the number of moving parts, which necessarily complicates fabrication, increases costs attributable thereto and also presents numerous potential sources for malfunction.

It is therefore an object of the present invention to provide a new and improved circuit interrupter mechanism. Another object of the invention is to provide a new and improved circuit interrupter mechanism which is adapted for protecting a primary circuit against ground fault.

It is also an object of the present invention to provide a new and improved circuit interrupter mechanism characterized by simple mechanical design for low cost, as well as rugged construction for durability and dependability.

It is a further object of the present invention to provide a new and improved circuit interrupter mechanism capable of resetting for repeated use.

It is yet another object of the present invention to provide a new and improved circuit interrupter mechanism having an indicator rod to indicate the status of the relay both during normal operation and in conjunction with test circuitry.

Objects and advantages of the invention are set forth in part herein and in part will be appreciated herefrom, or may be learned by practice with the invention, the same being realized and attained by means of the instrumentalities and combinations pointed out in the appended claims. Accordingly, the invention resides in the novel parts, constructions, arrangements combinations and improvements herein shown and described.

SUMMARY OF THE INVENTION

Briefly described, the circuit interrupter mechanism according to the present invention includes a movable member pivotally mounted within a suitable housing and having at least one electrical contact fastened to its free end for mating with a corresponding contact fixedly mounted in the housing, first biasing means coupled between said movable member and a suitable structure for preventing rotation of the movable member to mate the contacts, an actuating arm slidably pivotally mounted in said housing for engaging the movable member, second biasing means coupled between said actuating arm and a suitable structure for effecting mating between the aforesaid contacts when the actuating arm and movable member are engaged, and activation means for causing the actuating arm to disengage the movable member when energized by predetermined fault conditions in the primary circuit, as detected by sensing means constructed to detect predetermined circuit conditions. Advantageously, and as here preferably embodied, the activation means includes an electromagnet whose windings are coupled to the sensing means for energization thereby. In addition, the actuating arm is a ferromagnetic latch-like member which is attracted by the electromagnet upon energization such that the movable member is disengaged from the latching structure.

Also advantageously and as here preferably embodied, the second biasing means comprise a tension spring attached between a suitable structure in the housing and an attachment point on the actuating arm located generally away from its slidably pivotally mounted end and generally near its movable member engaging end. In addition, the first biasing means comprise a compression spring attached between the movable member and a suitable buttressing structure located in the housing on the contact-bearing side of the movable member such that the moment generated by the second biasing means acting on the movable member when the latter is engaged by the actuating arm exceeds or dominates the moment generated by the first biasing spring acting on the movable member. Thus, during normal use, when the actuating arm and the movable member are engaged, the contacts are mated and the primary circuit is closed. However, when the sensing means detect the predetermined conditions in the primary circuit, it energizes the electromagnet which attracts the actuating arm such that the latter disengages the movable member and the contacts are parted to open the circuit.

It will be apparent from the foregoing general description that the objects of the invention specifically enumerated herein are accomplished by the invention as here embodied. Accordingly, it has been found that circuit interrupter apparatus can be constructed according to the invention, which is substantially less complicated than circuit breakers heretofore known for substantially reducing fabrication costs and potential sources of mechanical failure, while offering rugged construction for durability.

Thus, it has been found that by providing a circuit interrupter relay which includes only two basic moving or operable members mechanically simple interrupter apparatus is provided, which is relatively inexpensive and simple to fabricate and which substantially minimizes the number of parts subject to mechanical failure. Accordingly, by utilizing biasing means coupled between the operable members and a structure mounted to the housing (or to the housing itself), the apparatus according to the invention has been found to be ruggedly constructed and operable by simple movements which minimizes the possible sources for mechanical failure.

In addition, it has also been found that by positioning the first biasing spring generally nearer the pivotal connecting point than the engagement point of the actuating arm with the movable member, the need for determining the relative strengths of the two biasing springs is obviated, as any comparably power springs may be employed due to variation in the distances from the pivot point each spring acts. Furthermore it will be found that the interrupter mechanism according to the present invention can be adapted for use with any sensing means for opening the primary circuit, and has been found particularly useful when used with ground fault sensing means in a ground fault interrupter (GFI).

It will also be understood that the foregoing general description as well as the following detailed description are exemplary and explanatory of the invention but are not restrictive thereof. Accordingly, the accompanying drawings, referred to herein and constituting a part hereof, serve to illustrate preferred embodiments of the invention, and, together with the detailed description, serve to explain the principles of the invention.

DETAILED DESCRIPTION OF THE INVENTION

Figure 1:
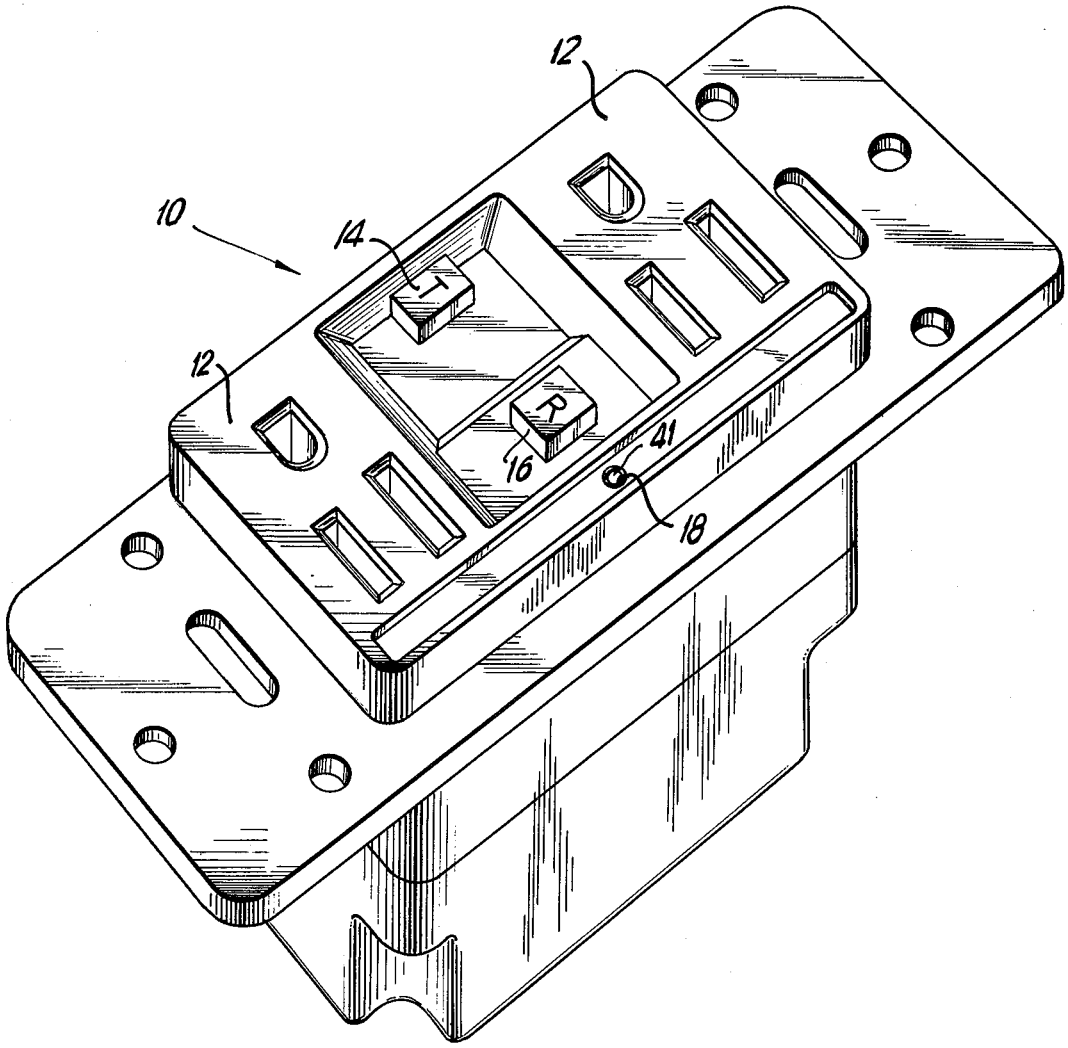
FIG. 1 is a front view of an electrical receptacle assembly utilizing the circuit interrupter mechanism according to the present invention.

Referring now to the embodiments of apparatus according to the invention illustrated in the accompanying drawings, wherein like reference numerals indicate like parts throughout the various views, there is shown in FIG. 1 a front view of receptacle housing 10 containing circuit interrupter apparatus according to the present invention. The housing 10 is provided with at least one electrical socket 12 (here a three-pronged grounded socket). The housing may also include reset button 16 for resetting the interrupter apparatus as hereinafter described, test button 14 for testing the operability of the relay, and aperture 18 for viewing an indicator rod which may appear therein when the primary circuit is operable.

Figure 3:
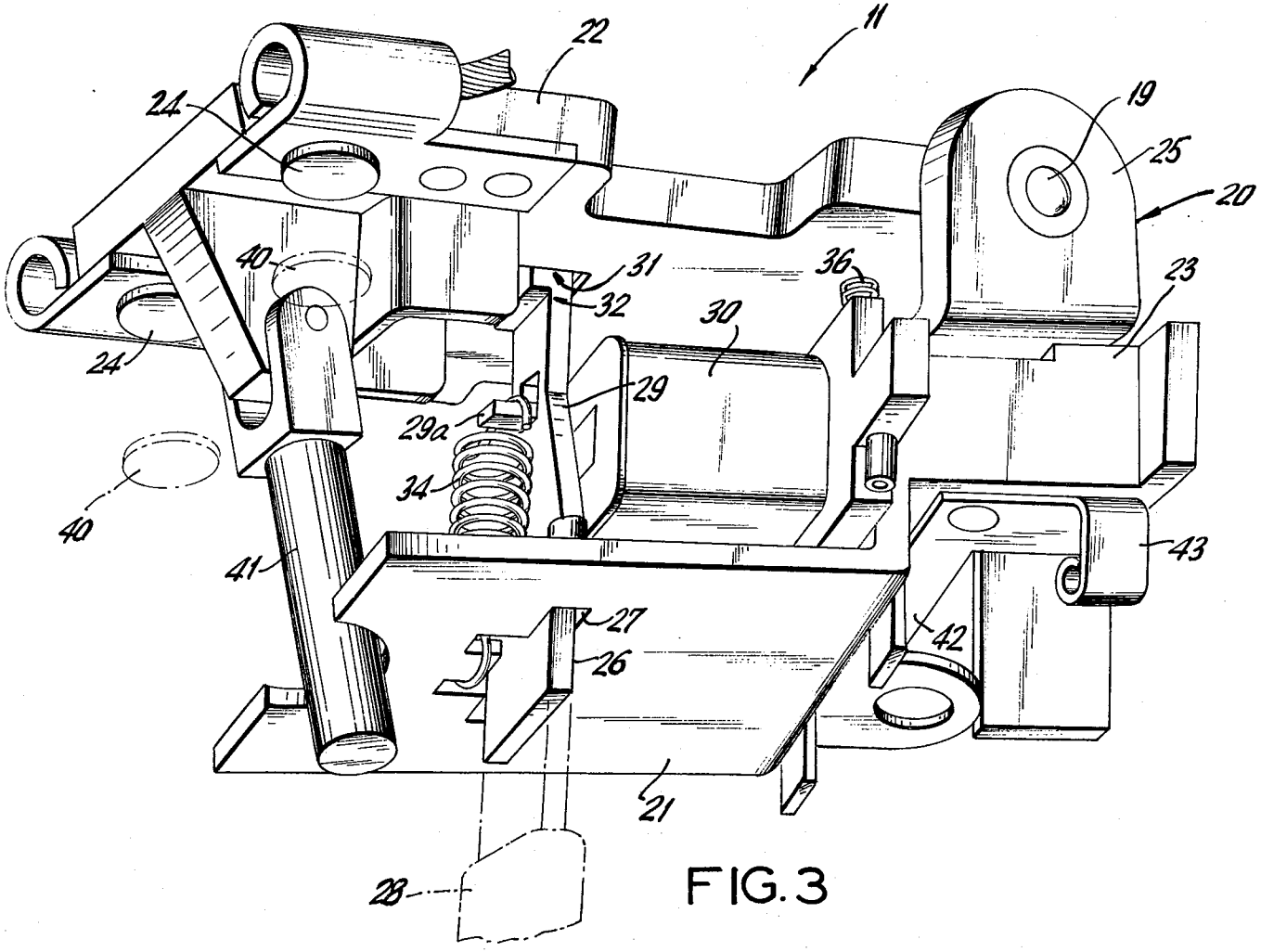
FIG. 3 is a perspective view of a preferred embodiment of the circuit interrupter mechanism according to the present invention, in the open or "tripped" configuration.

Referring now to FIG. 3, a preferred embodiment of circuit interrupter mechanism according to the present invention is shown (indicated generally by reference numeral 11). Interrupter apparatus 11 includes movable member 22 pivotally mounted within housing 10 (as indicated by pivot point 19) with at least one electrical contact 24 affixed to its free end for mating with corresponding contact 40 affixed within housing 10. Actuating arm 29 is advantageously slidably pivotally mounted within housing 10, as more fully described hereinafter, and adapted to engage movable member 22 for bringing contacts 24 and 49 into mating relation when closure of the primary circuit is desired. Activation means 30, preferably in the form of an electromagnet coupled to sensing means (not shown) mounted within the housing, is adapted for disengaging actuating arm 29 from movable member 22 and thereby disengage the mating between contacts 24 and 40, as more fully described hereinafter.

Advantageously, a frame (indicated generally by reference number 20) may be mounted in the receptacle housing 10 for supporting various elements comprising interrupter 11 in an integral manner instead of securing these elements directly to the housing, although it will be understood that such securing may be satisfactory. Accordingly, frame 20 may include base portion 21, post portion 23, and pivot bracket 25. As preferably embodied, pivot bracket 25 is formed on top of post portion 23 for pivotally supporting movable member 22 which carries one or more electrical contacts 24 such that contacts 24 are movable with respect to stationary contacts 40 rigidly affixed within housing 10. Base portion 21 of frame 20 may be provided with means for slidably and pivotally mounting actuating member 29 thereto such that actuating member 29 may engage and be disengaged from movable member 22 as hereinafter described. Post portion 23 is adapted to support operating means 30, which preferably comprises an electromagnet, and the test switch assembly.

Movable member 22 is pivotally attached at pivotal end 19 to pivot bracket 25 of frame 20 such that the movable member is capable of "swinging" away from and towards base portion 21. Accordingly, movable electrical contacts 24, affixed to the free end of movable member 22, come into and out of mating relation with stationary contacts 40 mounted in housing 10. Movable member 22 is also provided with receiving means 31 adapted to accommodate engagement by fastening means 32 formed on the actuating member 29, in order to allow movable member 22 to become engaged by actuating member 29 for bringing the movable and stationary contacts together. To this end, biasing means 34 are coupled to actuating member 29 to urge the free end of movable member 22 towards base portion 21 when member 22 is engaged by member 29.

Advantageously, and as here preferably embodied, means formed on base portion 21 for slidable pivotal mounting of actuating member 29 comprises aperture 27 formed in base portion 21 with first end 26 of actuating member 29 extending through aperture 27. Thus, end 26 of actuating arm 29 is slidable into and out of aperture 27, generally perpendicular to base portion 21. Also advantageously, actuating member 29 is provided with shoulder means 29*b* (best shown in FIGS. 4*a* and *b*), near free end 26, both to restrict the distance free end 26 extends into aperture 27 and to provide a fulcrum by which actuating member 29 may assume a pivotable posture. To this end, opening 27 is proportioned to allow such front-to-back pivotal action but prevent any significant side-to-side twisting motion of actuating member 29.

Figure 4A:
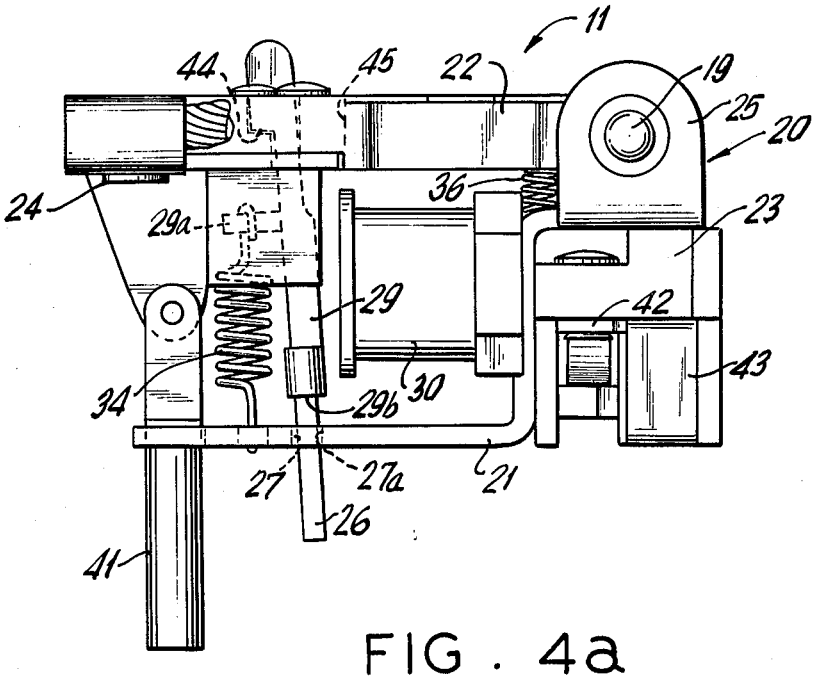
FIGS. 4*a*, 4*b* and 4*c* are side views of the circuit interrupter mechanism according to the invention, in respectively, closed, open and resetting configurations.
Figure 4B:
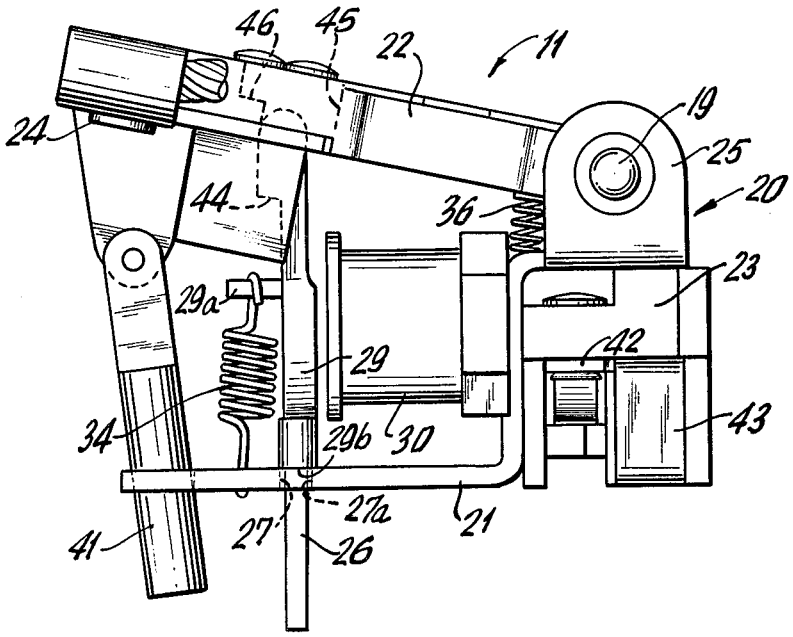

In conjunction with these structures, it has been found particularly useful to attach biasing means 34 in slight tension between base portion 21 (at or near the front end of opening 27, as shown in FIGS. 3, 4*a* and *b*) and the front of actuating member 29, just below fastening means 32, as by protrusion 29a. According to this configuration, actuating member 29 is thereby retained in a relatively stationary pivoting position with shoulders 29*b* urged against base portion 21. In addition, the free end of actuating member 29 is provided with slightly forward inclination, away from post portion 23 to which disengaging means 30 are mounted for disengaging actuating member 29 from movable member 22, as hereinafter described. This forward inclination is also particularly useful in relation to the operation of fastening means 32/receiving means 31, as hereinafter described.

Advantageously, biasing means 36 may be positioned between movable member 22 and frame 20 to urge movable member 22 away from base portion 21, and thereby resist the mating of contacts 24 and 40. As preferably embodied, biasing means 36 is a compression spring mounted to post portion 23 and adapted to engage movable member 22, as contacts 24 and 40 are attempted to be mated. Biasing means 36 is advantageously positioned between pivotal engagement point 19 and receiving means 31 — and, preferably, generally closer point 19 than 31 — in order that the biasing effect attributable to biasing means 34 will dominate that attributable to biasing means 36 when movable member 22 is engaged by actuating member 29. Thus, since the moment arms along member 22 by which biasing means 34 and 36 act on member 22 are significantly different, any biasing means 34 and 36 of roughly comparable strength may be utilized to achieve the desired result.

Accordingly, when movable member 22 is engaged by actuating member 29, the resultant moment vis-a-vis pivotal end 19 exerted on the movable member, by the influence of biasing means 34, urges movable member 22 toward the base portion 21, bringing the electrical contacts into mating relationship. However, when the actuating member 29 is disengaged from the movable member biasing means 36 immediately forces the contacts to part.

Figure 6:
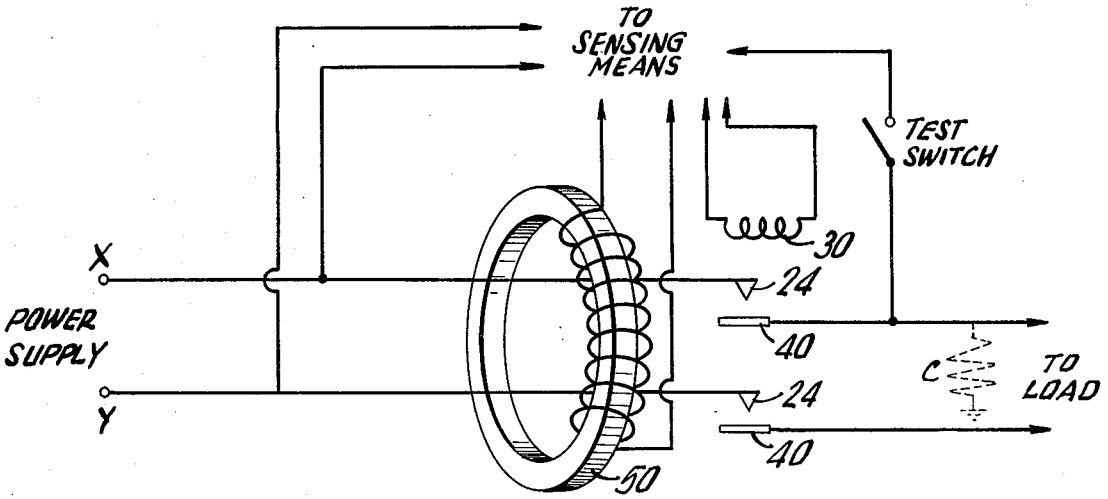
FIG. 6 is a circuit diagram for one embodiment of a ground fault circuit interrupter relay according to the present invention.

Operating or release means 30 are mounted in housing 10 and operably coupled to current fault sensing means (not shown) which may also be mounted in housing 10. Operating means 30 is activated by the current sensing means to "trip" the interrupter by causing disengagement between movable member 22 and actuating member 29 in response to predetermined conditions in the circuit. Advantageously, operating means 30 comprises an electromagnet having its windings connected to the sensing means (as shown in FIG. 6) such that coil 30 is energized thereby. In addition, actuating member 29 is preferably made of a ferro-magnetic material to react to coil 30 and be attracted thereto.

Accordingly, in operation, when the predetermined circuit conditions are reached in the protected circuit and detected by the sensing means, electromagnet 30 is energized. Actuating member 29 is thereby attracted towards electromagnet 30 and becomes disengaged from movable member 22, whereby contacts 24 and 40 are parted and the circuit is opened.

In a particularly useful embodiment, the relay according to the present invention includes indicator rod 41 pivotally mounted near the free end of movable member 22 such that the free end of the rod is visible in aperture 18 of the receptacle housing 10 to indicate operable status of the relay. Furthermore, test switch 42 and test switch connections 43 may be mounted to frame 20 and connected to suitable means such that the predetermined circuit conditions may be simulated. Accordingly, test switch 14 may be activated to simulate the circuit condition against which protection is sought. If indicator rod 41 disappears from view, it may safely be assumed that the relay is operable. However, if the indicator rod remains visible through aperture 18, it is an indication of some malfunction in the device or that the contacts have become welded together.

Figure 5A:
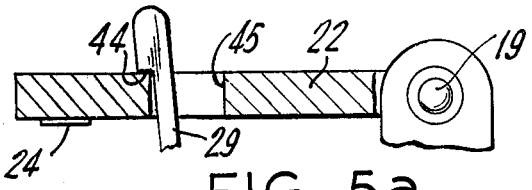
FIGS. 5*a* and 5*b* are alternate embodiments of the sear and engaging mechanism according to the invention.

Referring now to FIG. 5a, fastening means 32 on the free end of actuating member 29 may advantageously comprise sear 44 formed near the free end of member 29 and the receiving means on movable member 22 may advantageously comprise an aperture formed therein (denoted by reference numeral 45). Aperture 45 is dimensioned so as to accommodate the linar insertion of the free end of member 29 therethrough when the reset button is pressed (as hereinafter described), as well as the rearward, slightly arcuate, travel of that free end when member 29 is attracted to electromagnet 30. Accordingly, when reset is desired, reset button 28 (FIG. 3) is pressed to cause the free end of member 29 to be inserted into aperture 45 until sear 44 passes over the front top edge of aperture 45 (due to the slightly forward inclination imparted to member 29 by biasing means 34). Thus, according to the relay apparatus of the present invention, if reset is attempted while the fault in the circuit has not been corrected, the relay will re-trip immediately without risking serious injury to personnel or damage to property. Accordingly, as lip 44 engages the edge of aperture 45 and moves the free end of member 22 into mating configuration for contacts 24 and 40, the sensing means should immediately detect the problem conditions again and energize coil 30 which again attracts the free end of member 29, disengaging members 22 and 29 to reopen the circuit, all virtually immediately upon mating of contacts 24 and 40.

Advantageously, the free end of actuating member 29 is generally rounded for easy insertion past the front edge of aperture 45 in view of the inclination of member 29. In addition, reset button 28 preferably is not structurally connected to acutating arm 29 in order that an operator will be incapable of manipulating the position of the free end of member 29 or the orientation of member 29. Thus, once the relay has tripped and reset is attempted while the fault conditions have not been corrected, the relay can re-trip, as described hereinbefore, with no chance of interference or override by a negligent operator.

Figure 2:
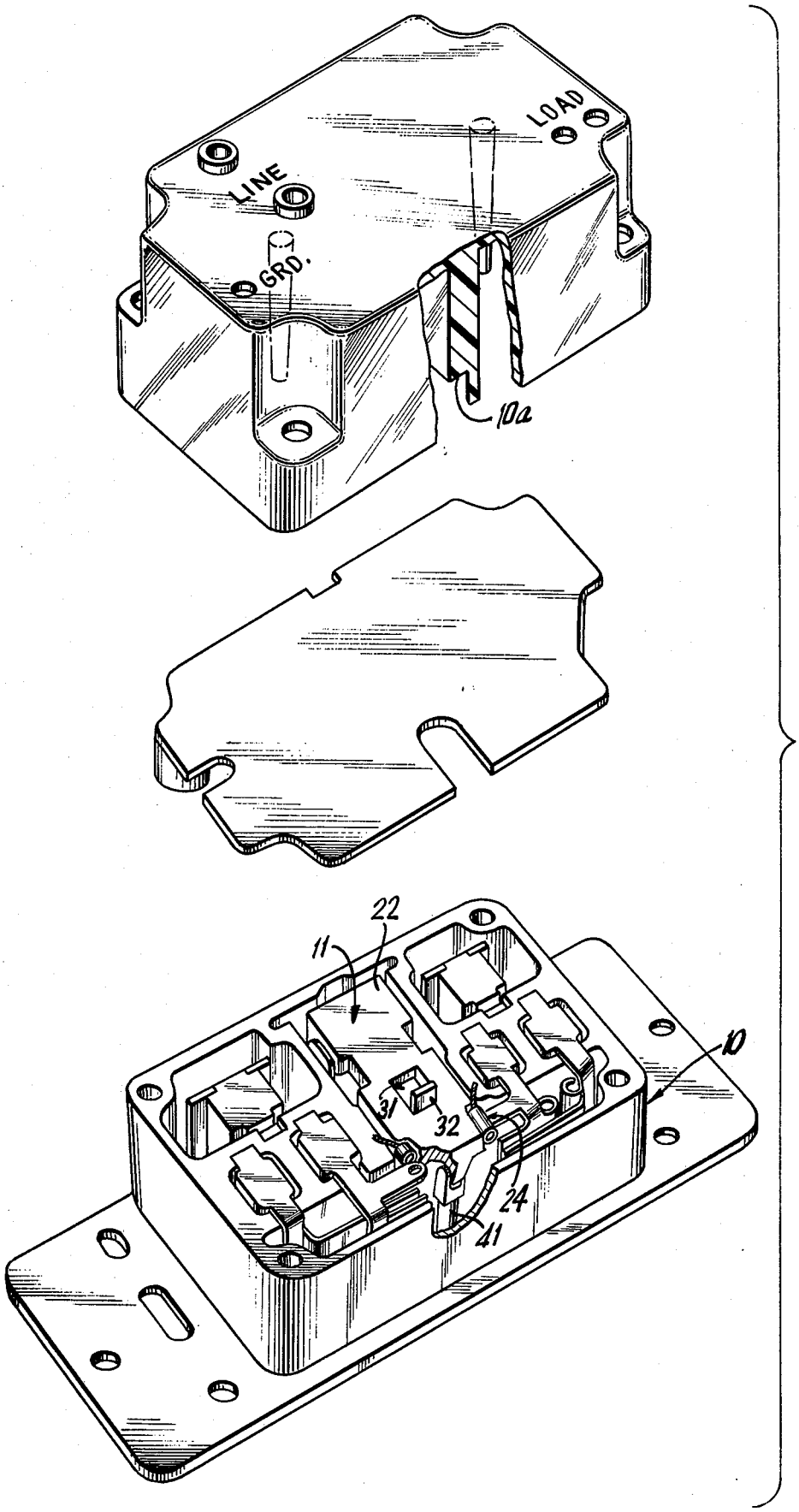
FIG. 2 is an exploded, partially cutaway, rear view of the electrical receptacle assembly of FIG. 1.
Figure 5B:
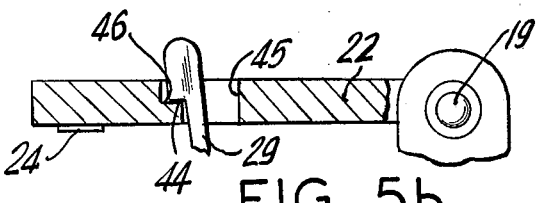

Advantageously, and as here preferably embodied, aperture 45 may be provided with lip means 46 to provide a ledge for engaging sear 44, rather than the top front edge (as indicated in FIG. 5a) of movable member 22, as shown in FIG. 5b. This feature is particularly useful where a hard material is desired for engagement with the metallic sear 44 to enable substantial withstanding of frictional wear generated by repeated use and thereby reduce the risk of nuisance tripping after the device has tripped and been reset repeatedly. In addition, this feature can reduce the distance actuating member 29 must travel to engage movable member 22 and thereby minimize the size of the housing necessary to accommodate tripping and resetting movements, and thereby enable convenient installation. To this end, the rear portion of housing 10 may be provided with abutment 10*a* (FIG. 2) to restrict the travel of the free end of movable member 22.

Figure 4C:
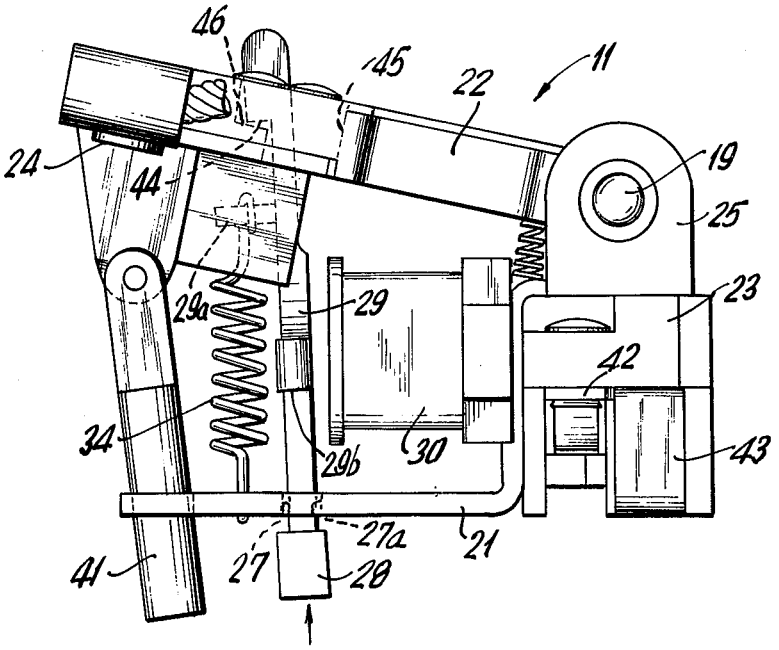

Thus, as reset button 28 is pushed inwardly as shown in FIG. 4*c*, the mounted end of actuating member 29 slidably abuts an edge (indicated as 27*a*) of mounting aperture 27, thereby enabling member 29 to be rotatable about a fixed axis (as member 29 slides along that edge), substantially defined by that edge of aperture 27, substantially without imparting any twisting of member 29. Once sear 44 has passed lip 46 (or the upper side of movable member 22 if lip 46 is not provided), members 29 and 22 become engaged in a rachet-like manner. However, as a principal advantage of the invention, mating of contacts 24 and 40 is not effected until the operator releases reset button 28. Thus, there is no way an operator can manually override the automatic tripping of interrupter apparatus according to the invention for keeping the circuit closed when the unsafe condition has not been corrected, since if the reset button is continuously pressed, the circuit will remain open. Furthermore, once the contacts touch and the fault condition is again detected, electromagnet 30 is energized and member 29 attracted to it, despite any manipulation the operator may attempt.

According to a preferred embodiment of the present invention, the sensing means comprises ground fault sensing means for detecting any circuit-to-ground current leakage. Advantageously, the ground fault sensing means should be sensitive to a ground fault leakage of about 5 mili-amps. A particularly useful ground fault sensing device is that sold by Syracuse Electronics Corp., since it includes means for automatically de-energizing electromagnet 30 immediately after the protected circuit is opened, as well as test circuitry for simulating a ground fault to test the device.

A circuit diagram for one embodiment of a ground fault interrupter relay according to the present invention is shown in FIG. 6, showing the relay coupled to an A.C. power source with the "hot", or line, conductor connected to the X lead of the relay and the neutral conductor connected to the Y lead. Thus, in operation, reset button 16 is pushed inwardly and the free end of actuating member 29, carrying fastening means 32, is also moved inwardly until it engages receiving means 31. Once engaged, the free end of movable member 22 is urged toward base portion 21 of frame 20 under the influence of biasing means 34. Thus, electrical contacts 24 carried on the free end of the movable member will be brought into mating relation with stationary contacts 40 mounted to the housing for passing current from the power source to the load.

When a current leak occurs, as indicated by grounded resistor (shown at C), there will be an imbalance of current in the circuit and therefore in the pair of conductors, X and Y, passing through the torroid of the ground fault sensing means. This current imbalance induces a current in the windings of the torroid, which is detected by the remaining circuitry of the sensing means, causing 120 volts, or the line voltage, to be applied across coil 30. Coil 30 is thereby transformed into an electromagnet which attracts the free end of actuating member 29, disengaging member 29 from movable member 22. The contact-bearing end of the movable member is thereby freed and urged away from stationary contacts 40 under the influence of biasing means 36 to open the circuit.

In a particularly useful embodiment, as described generally above, test switch circuits 42 and indicator rod 41 may be provided in order to ascertain whether the relay is functioning. Thus, with the aforesaid simulation circuitry incorporated in the ground fault sensing means, test switch circuitry 42, including manually operable switch means, may be included on frame 20 and coupled to the simulation circuitry for testing the operability of the relay. Thus, when test button 14 is depressed, an imbalance of current through the torroid is simulated, energizing electromagnetic coil 30 and opening the contacts as described hereinbefore.

The invention in its broader aspects is not limited to the specific embodiments herein shown and described, but, variations may be made therefrom within the scope of the accompanying claims, without departing from the principles of the invention and without sacrificing its chief advantages. Furthermore, it will be appreciated that by pivotally mounting the movable member with release means and the actuating member compactly positioned thereunder, the volume of housing required for containing the interrupter is minimized to enhance the convenience of installation.

What is claimed is:

1. Circuit interrupter apparatus comprising:

a housing;

at least one stationary electrical contact fixedly mounted in said housing;

conductor means for coupling each said stationary contact to one of a source of electrical current and an electrical load;

a movable member pivotally mounted in said housing;

at least one first electrical contact mounted to said movable member, said first contact positioned on said movable member for mating engagement with said stationary contact;

conductor means for coupling each said first contact to the other of said current source and load;

an actuating member slidably and pivotally mounted in said housing and adapted for releasably engaging said movable member to bring said first and stationary contracts into mating engagement;

first biasing means coupled between said movable member and said housing adapted to resist mating of said first and stationary contacts;

second biasing means coupled between said actuating member and said housing and adapted to achieve said mating of said first and stationary contacts when said actuating member is engaged with said movable member;

release means suitably positioned in said housing near said actuating member for causing engagement between said actuating member and said movable member to be released, said release means coupled to sensing means adapted to detect predetermined circuit conditions for activiating said release means upon detecting the predetermined conditions, such that, when said sensing means detect the predetermined circuit conditions, said sensing means activates said release means for disengages said actuating and movable members to disengage the mated first and stationary contacts, and, when re-mating is desired, said actuating member is manually translated by an operator while said second biasing means urges said actuating member to rotate into engagement with said movable member, and, after said actuating member has engaged said movable member, mating of said contacts is effected only when the actuating member has been released by said operator, said second biasing means causing, through the actuating member, said first and stationary contacts to mate.

2. Circuit interrupter apparatus according to claim 1 wherein said movable member is formed with lip means suitable for engagement by a sear and said actuating member is a generally elongate member slidably and pivotally mounted in said housing generally at one end and formed with sear means, adapted to engage said lip means, generally at its other, free, end.

3. Circuit interrupter apparatus according to claim 2 wherein said housing is provided with a mounting aperture into which said one end of said actuating member is inserted for abutting a reset button provided in the housing with an exteriorly exposed surface; wherein said actuating member is formed with a shoulder adapted to prevent linear movement of said one end beyond a predetermined point in the direction of said reset button; and, wherein said second biasing means comprises a spring coupled in tension between a point in said housing substantially near said mounting aperture and a point on said actuating arm generally near said sear such that said tension spring urges the shoulder of said actuating arm to abut said mounting aperture and to pivot about a generally fixed axis, and such that said sear means of said actuating member tends to rotate slightly beyond the point whereat full engagement between said sear means and said lip means will be made.

4. Circuit interrupter apparatus according to claim 2 which further includes a frame mounted in said housing, said frame comprising:

a base portion having a mounting aperture formed therein into which said one end of said actuating member is inserted for abutting a reset button provided in the housing with an exteriorly exposed surface; and a post portion formed with means to provide pivotal mounting of said movable member generally spaced away from said base portion; and, wherein said actuating member is formed with a shoulder adapted to prevent linear movement of said one end of said actuating member beyond a predetermined point in the direction of said reset button, and said second biasing means comprises a spring coupled in tension between a point on said base portion substantially near said mounting aperture and a point on said actuating arm generally away from said one end, such that said tension spring urges the shoulder of said actuating arm to abut said mounting aperture and urges said actuating arm to pivot about a generally fixed axis, and such that said sear means of actuating member tends to rotate slightly beyond the point whereat full engagement between said sear means and said lip means will be made.

5. Circuit interrupter apparatus comprising:

a housing;

at least one stationary electrical contact fixedly mounted in said housing;

conductor means for coupling each said stationary contact to one of a source of electrical current and an electrical load;

a movable member pivotally mounted in said housing, said movable member including lip means;

at least one first electrical contact mounted to said movable member, said first contact positioned on said movable member for mating engagement with said stationary contact;

conductor means for coupling each said first contact to the other of said current source and load;

a generally elongate actuating member slidably and pivotally mounted at one end in said housing, said actuating member having sear means forward at its other end, said sear means adapted for releasably engaging said lip means on said movable member to bring said first and stationary contacts into mating engagement when said sear and lip means are engaged;

a mounting aperture provided in said housing, said aperture adapted to accommodate slidable insertion of said one end of said actuating member and to permit pivotal movement of said actuating member;

a shoulder formed on said actuating member generally near said first end, said shoulder adapted to prevent slidable movement of said one into said aperture beyond a predetermined point;

a reset button provided in said housing with an exteriorly exposed surface, said reset button adapted to abut said one end of said actuating member when inserted in said mounting aperture;

first biasing means coupled between said movable member and said housing, said first biasing means adapted to resist mating of said first and stationary contacts;

a spring coupled in tension between a point in said housing substantially near said mounting aperture and a point on said actuating member generally near said sear means, said tension spring urging the shoulder of said actuating member to about said mounting aperture and to pivot about a generally fixed axis and urging said other end of said actuating member to rotate slightly beyond the point whereat full engagement between said sear and lip means will be made, said tension spring adapted to provide sufficient biasing to cause mating of said contacts when said sear and lip means are engaged;

an electromagnet positioned in said housing in generally close proximity to said actuating member, said electromagnet coupled to sensing means adapted to detect predetermined circuit conditions and to activate said electromagnet when the predetermined circuit conditions have been detected, said actuating member being made from a magnetically attractive material for attraction towards said electromagnet when energized to release engagement between said actuating and movable members, such that, when said sensing means detect the predetermined circuit conditions, said sensing means activate said electromagnet for disengaging said actuating and movable members to disengage the mated first and stationary contacts, and, when remating is desired, said actuating member is manually translated by an operator pushing said reset button, with said tension spring urging said actuating member to rotate for engagement between said sear and lip means, and, after said sear means of said actuating member has engaged said lip means of said movable member, mating of said first and stationary contacts is effected only when the reset button has been released by the operator, causing said tension spring, through the actuating member, to effect mating of said first and stationary contacts.

6. Circuit interrupter apparatus according to claim 5, wherein said movable member is formed with a receiving aperture intermediate its pivotally mounted end and its free end, with an edge of said receiving aperture adapted to provide said lip for engagement by said sear means, said receiving aperture dimensioned to accommodate inward insertion of the free end of said actuating member and the slightly arcuate movement of said actuating member free end when attracted to said electromagnet.

7. Circuit interrupter apparatus according to claim 6 which further includes insert means attached at said edge of said receiving aperture on the side of said movable member closest to said mounting aperture, said insert means adapted for engagement with said sear on said actuating member, and, wherein the edge of said free end of said actuating arm is substantially rounded to facilitate insertion thereof into said receiving aperture.

8. Circuit interrupter apparatus according to claim 5 wherein said movable member is provided with two first contacts and said housing is provided with two stationary contacts, such that two circuits can be governed by one circuit interrupter apparatus.

9. Circuit interrupter apparatus according to claim 8 which further includes an indicator rod pivotally mounted to said movable member and wherein said housing is formed with a viewing aperture adapted to slidably receive said indicator rod such that, when said contacts are mated, said indicator rod is visible in said viewing aperture and when said contacts are not mated, said indicator rod is not visible in said viewing aperture.

10. Circuit interrupter apparatus according to claim 8 which further includes test circuiry for simulating the predetermined circuit conditions to enable the operability of said circuit interrupter apparatus to be tested.

11. Circuit interrupter apparatus according to claim 8 wherein said sensing mean comprises ground fault sensing means for detecting ground fault current leakage.

12. Circuit interrupter apparatus according to clain 10 which further includes an indicator rod pivotally mounted to said movable member and wherein said housing is formed with a viewing aperture adapted to slidably receive said indicator rod such that, when said contacts are mated, said indicator rod is visible in said viewing aperture and when said contacts are not mated, said indicator rod is not visible in said viewing aperture.

13. Circuit interrupter apparatus according to claim 12 which further includes test circuitry for stimulating the predetermined circuit conditions to enable the operability of said circuit interrupter apparatus to be tested.

14. Circuit interrupter apparatus comprising:

a housing;

at least one stationary electrical contact fixedly mounted in said housing;

conductor means for coupling each said stationary contact to one of a source of electrical current and an electrical load;

a movable member pivotally mounted in said housing, said movable member formed with engaging means;

at least one first electrical contact mounted to said movable member, said first contact positioned on said movable member for mating engagement with said stationary contact;

conductor means for coupling each said first contact to the other of said current source and load;

an actuating member slidably and pivotally mounted, generally at one end, in said housing and formed with latching means at its other end, said latching means adapted to releasably latchably engage said engaging means on said movable member to bring said first and stationary contacts into mating engagement;

a frame mounted in said housing, said frame including:

a base portion having a mounting aperture formed therein, said aperture adapted to accommodate slidable insertion of said one end of said actuating member, and a post portion formed with means to provide said pivotal mounting of said movable member generally spaced away from said base portion;

a shoulder formed on said actuating member generally near said one end, said shoulder adapted to prevent slidable insertion of its said one end into said aperture beyond a predetermined point;

a reset button provided in said housing with an exteriorly exposed surface, said reset button adapted to abut said one end of said actuating member when inserted in said mounting aperture;

first biasing means coupled between said movable member and said housing, said first biasing means adapted to resist mating of said first and stationary contacts;

a spring coupled in tension between a point on said base portion substantially near said mounting aperture and a point on said actuating member generally away from said one end, said tension spring urging the shoulder of said actuating member to abut said mounting aperture and to pivot about a generally fixed axis and urging the other end of said actuating member to tend to rotate into engagement with said engaging means on said movable member, said tension spring adapted to provide sufficient biasing to cause mating between said first and stationary contacts when said latching and engaging means are engaged;

an electromagnet positioned in said housing in generally close proximity to said actuating member, said electromagnet coupled to sensing means adapted to detect predetermined circuit conditions and to activate said electromagnet when the predetermined circuit conditions have been detected, said actuating member being made from a magnetically attractive material for attraction towards said electromagnet when energized, to release engagement between said actuating and movable members, such that, when said sensing means detect the predetermined circuit conditions, said sensing means activate said electromagnet for disengaging said actuating and movable members to disengage the mated first and stationary contacts, and, when remating is desired, said actuating member is manually translated by an operator pushing said reset button, with said tension spring urging said actuating member to rotate into engagement with said movable member, and, after said actuating member has engaged said movable member, mating of said first and stationary contacts is effected only when the reset button has been released by the operator, causing said tension spring, through the actuating member, to effect mating of first and stationary contacts.

15. Circuit interrupter apparatus according to claim 14 wherein said engaging means comprises lip means found on said movable member, said latching means comprise sear means formed generally at said other end of said activating member, and said actuating member is adapted to rotate such that said sear means tends to travel slightly beyond the point whereat full engagement between said sear and lip means will be made.

16. Circuit interrupter apparatus according to claim 15, wherein said movable member is formed with a receiving aperture intermediate its pivotally mounted end and its free end, with an edge of said receiving aperture adapted to provide said lip means for engagement by said sear means, said receiving aperture dimensioned to accommodate inward insertion of the free end of said actuating member and the slightly arcuate movement of the other end of said actuating member when attracted to said electromagnet.

17. Circuit interrupted apparatus according to claim 16, which further includes insert means attached at said edge of said receiving aperture on the side of said movable member closest to said mounting aperture, said insert means adapted for engagement with said sear on said actuating member, and, wherein the edge of said other end of said actuating member is substantially rounded to facilitate insertion thereof into said receiving aperture

18. Circuit interrupter apparatus according to claim 17 wherein said movable member is provided with two said first contacts and said housing is provided with two said stationary contacts, such that two circuits can be governed by one circuit interrupter apparatus.

19. Circuit inerrupter apparatus according to claim 18 which further includes an indicator rod pivotally mounted to said movable member and wherein said housing is formed with a viewing aperture adapted to slidably receive said indicator rod such that, when said contacts are mated, said indicator rod is visible in said viewing aperture and when said contacts are not mated, said indicator rod is not visible in said viewing aperture.

20. Circuit interrupter apparatus according to claim 19 which further includes test circuitry for simulating the predetermined circuit conditions to enable the operability of said circuit interrupter apparatus to be tested.

21. Circuit interrupter apparatus according to claim 18 wherein said sensing means comprises ground fault sensing means for detecting ground fault current leakage.

22. Circuit interrupter apparatus according to claim 21 which further includes an indicator rod pivotally mounted to said movable member and wherein said housing is formed with a viewing aperture adapted to slidably receive said indicator rod such that, when said contacts are mated, said indicator rod is visible in said viewing aperture and when said contacts are not mated, said indicator rod is not visible in said viewing aperture.

23. Circuit interrupter apparatus according to claim 22 which further includes test circuitry for simulating the predetermined circuit conditions to enable the operablity of said circuit interrupter apparatus to be tested.

24. Circuit interrupter apparatus according to claim 16 wherein said electromagnet is affixed to said post member and said sear of said actuating member faces away from said electromagnet.

25. Circuit interrupter apparatus according to claim 24 wherein said first biasing means comprises a compression spring mounted to said post member generally near said pivotal mounting point on said movable member such that the moment generated about said pivotal mounting point by said second biasing means when said movable and actuating members are engaged is substantially greater than the moment generated by said first biasing means acting on said movable member.

* * * * *

UNITED STATES PATENT OFFICE

CERTIFICATE OF CORRECTION

Patent No. 4,086,549 Dated April 25, 1978

Inventor(s) Thomas S. Slater and Harald B. Jadatz

It is certified that error appears in the above-identified patent and that said Letters Patent are hereby corrected as shown below:

IN THE SPECIFICATION

Column 3, line 5, insert a comma before "mechanically";
Column 4, line 17, "49" should be --40--;
Column 6, line 27, "linar" should be --linear--;
Column 7, line 27, insert a comma after "since".

IN THE CLAIMS

Claim 1, line 37 (col. 8, line 67), "disengages" should be --disengaging--;
Claim 5, line 18 (col. 10, line 14), "forward" should be --formed--;
Claim 5, line 45 (col. 10, line 41), "about" should be --abut--;

Claim 13, line 2 (col. 11, line 56), "stimulating" should be --simulating--.

Signed and Sealed this

First Day of May 1979

[SEAL]

Attest:

RUTH C. MASON
Attesting Officer

DONALD W. BANNER
Commissioner of Patents and Trademarks

UNITED STATES PATENT OFFICE

CERTIFICATE OF CORRECTION

Patent No. 4,086,549 Dated April 25, 1978

Inventor(s) Thomas S. Slater et al.

It is certified that error appears in the above-identified patent and that said Letters Patent are hereby corrected as shown below:

Column 11, line 12, after "lip" insert -- means --

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*